US008125342B2

(12) United States Patent
Nguyen

(10) Patent No.: US 8,125,342 B2
(45) Date of Patent: Feb. 28, 2012

(54) ELECTRONIC ARTICLE SURVEILLANCE TAG

(75) Inventor: Thang Tat Nguyen, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 312 days.

(21) Appl. No.: 11/992,445

(22) PCT Filed: Nov. 23, 2007

(86) PCT No.: PCT/US2007/024352

§ 371 (c)(1), (2), (4) Date: Mar. 21, 2008

(87) PCT Pub. No.: WO2009/067102

PCT Pub. Date: May 28, 2009

(65) Prior Publication Data

US 2010/0148962 A1 Jun. 17, 2010

(51) Int. Cl.
*G08B 13/14* (2006.01)

(52) U.S. Cl. ..... 340/572.8; 340/572.9

(58) Field of Classification Search ..... 340/572.1, 340/572.8, 572.9

See application file for complete search history.

(56) References Cited

U.S. PATENT DOCUMENTS

| | | | | |
|---|---|---|---|---|
| 5,426,419 | A | 6/1995 | Nguyen et al. | |
| 6,373,390 | B1 * | 4/2002 | Hogan et al. | 340/572.8 |
| 2005/0091809 | A1 | 5/2005 | Xue et al. | |

* cited by examiner

*Primary Examiner* — Thomas Mullen
(74) *Attorney, Agent, or Firm* — Kacvinsky Daisak, PLLC

(57) ABSTRACT

An embodiment is an EAS tag that may be included in an EAS system. More specifically, an embodiment is an EAS tag including an arcuate channel and additional features to hinder the removal of the EAS tag with devices other than those specifically designed for such a purpose.

10 Claims, 13 Drawing Sheets

ELECTRONIC ARTICLE SURVEILLANCE TAG

BACKGROUND

Electronic article surveillance (EAS) systems are well known in the art and are used for inventory control and to prevent theft and similar unauthorized removal of articles from a controlled area. Typically, in such systems a system transmitter and a system receiver are used to establish a surveillance zone that must be traversed by any articles being removed from the controlled area.

An EAS tag is affixed to each article and includes a marker or sensor adapted to interact with a signal being transmitted by the system transmitter into the surveillance zone. This interaction causes a further signal to be established in the surveillance zone which further signal is received by the system receiver. Accordingly, upon movement of a tagged article through the surveillance zone, a signal will be received by the system receiver, identifying the unauthorized presence of the tagged article in the zone. An alarm may thereafter be triggered by the system receiver, on the EAS tag, or both, to further expose the unauthorized presence of the tagged article in the surveillance zone.

Certain types of EAS tags have been designed to be reusable and accordingly include releasable attachment devices for affixing the tags to the articles. Such attachment devices are further designed to be releasable by authorized personnel only so that unauthorized removal of a tag from its article is avoided. To this end, many attachment devices are made releasable only through the use of an associated special tool or detaching mechanism. Clever thieves, however, have developed methods to defeat some EAS tags.

SUMMARY

An embodiment is an electronic article surveillance (EAS) tag that forms part of an EAS system. In general, the EAS tag may include a sensor, transmitter, or the like to emit a detectable signal when it is located within a monitored surveillance zone. The EAS tag may be attached to anything, and may for example be attached to an article of clothing. A detaching device may remove an EAS tag when surveillance is not necessary (e.g., after the item has been purchased). While the EAS tag is attached to, for example, an article of clothing, a monitoring system may monitor the surveillance zone for the EAS tag signal to ensure that the article of clothing including the EAS tag is not removed from the surveillance zone without triggering an alarm or the like.

The EAS tag includes a tag body and a tack that detachably engages with the tag body via a pin. More specifically, the tag body includes a rotary clamp that detachably engages the pin to secure the tack to the tag body. The rotary clamp may be disengaged from the pin by accessing and actuating the rotary clamp through an arcuate channel formed in the tag body. The shape of the arcuate channel increases the difficulty of accessing the rotary clamp with anything other than a tool or probe specifically designed for such a purpose. Such a tool or probe, among other features, would share the radius of the arcuate channel.

The arcuate channel of an embodiment may further include a keyway through which the tool or probe must travel to access the rotary clamp and in turn disengage the rotary clamp from the tack pin. The keyway of an embodiment, based on the depth of the arcuate channel at which it is located and its opening relative to the arcuate channel coupled with the arcuate channel's features preceding and following the keyway, may individually and in combination further increase the difficulty of accessing the rotary clamp with anything other than the tool or probe specifically designed for such a purpose as noted above. Accordingly, the keyway and the features of the arcuate channel adjacent to the keyway cooperatively combat improvised methods for accessing the rotary clamp and subsequently deter unauthorized defeat of the EAS system thereby.

BRIEF DESCRIPTION OF THE DRAWINGS

The subject matter regarded as embodiments is particularly pointed out an distinctly claimed in the following portion of the specification. The embodiments, both as to organization an method of operation, may be best understood by reference to the following detailed description when read with the accompanying drawings in which:

DETAILED DESCRIPTION

Figure 1:
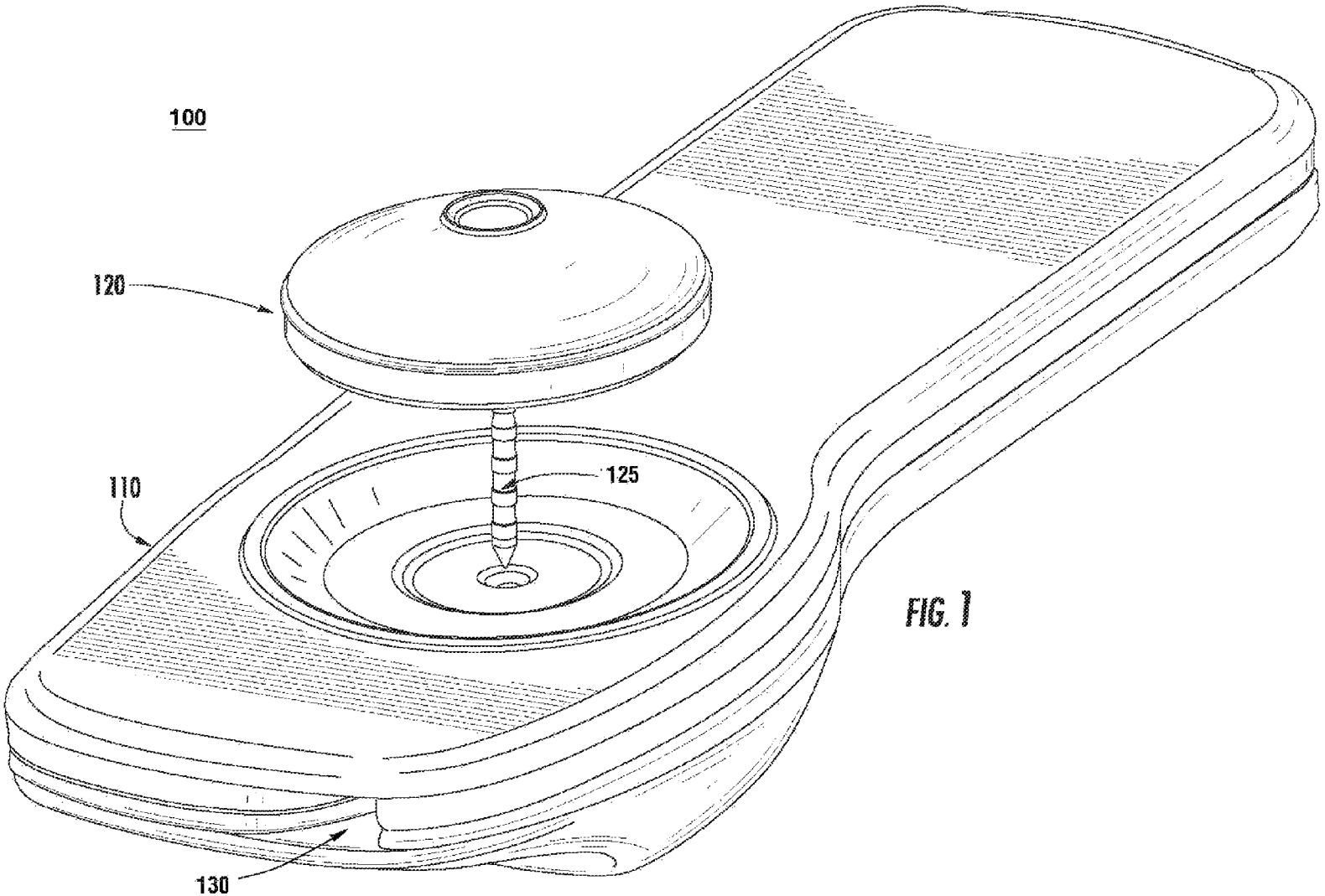
FIG. 1 illustrates an EAS tag of an embodiment.

Embodiments of an electronic article security tag will be described. Reference will now be made in detail to a description of these embodiments as illustrated in the drawings. While the embodiments will be described in connection with these drawings, there is no intent to limit them to drawings disclosed herein. On the contrary, the intent is to cover all alternatives, modifications, and equivalents within the spirit and scope of the described embodiments as defined by the accompanying claims.

One embodiment may comprise an EAS tag that may be included in an EAS system. More specifically, an embodiment is an EAS tag including an arcuate channel and additional features to hinder the removal of the EAS tag with devices other than those specifically designed for such a purpose. The EAS system may further include a detaching device and a monitoring system. In general, the EAS tag may include a sensor, transmitter, or the like to emit a detectable signal when it is located within a monitored surveillance zone. The EAS tag may be attached to anything, and may for example be attached to an article of clothing. The detaching device may remove an EAS tag when surveillance is not necessary (e.g., after the item has been purchased). While the EAS tag is attached to, for example, an article of clothing, the monitoring system may monitor the surveillance zone for the EAS tag signal to ensure that the article of clothing including the EAS tag is not removed from the zone without triggering an alarm or the like.

FIG. 1 illustrates EAS tag 100 including body 110, tack 120 including pin 125, and arcuate channel 130 within body 110. The EAS tag may be attached to any item, for example an article of clothing, by piercing the item or article of clothing with the pin 130 of tack 120 and detachably securing the pin 125 of tack 120 to the body 110. In an embodiment, the pin 130 is detachably secured to body 110 in such a manner that it requires a specially designed tool to detach the EAS tag 100 from the, for example, article of clothing. In the absence of such a tool, the EAS tag is difficult to remove. As noted, the body 110 of an embodiment may include a sensor, transmitter, or the like to emit a detectable signal when it is located within a monitored surveillance zone. Accordingly, the difficulty of removing the EAS tag 100 without the tool may deter the removal of the, for example, article of clothing including the EAS tag 100 from the monitored surveillance zone.

Figure 2:
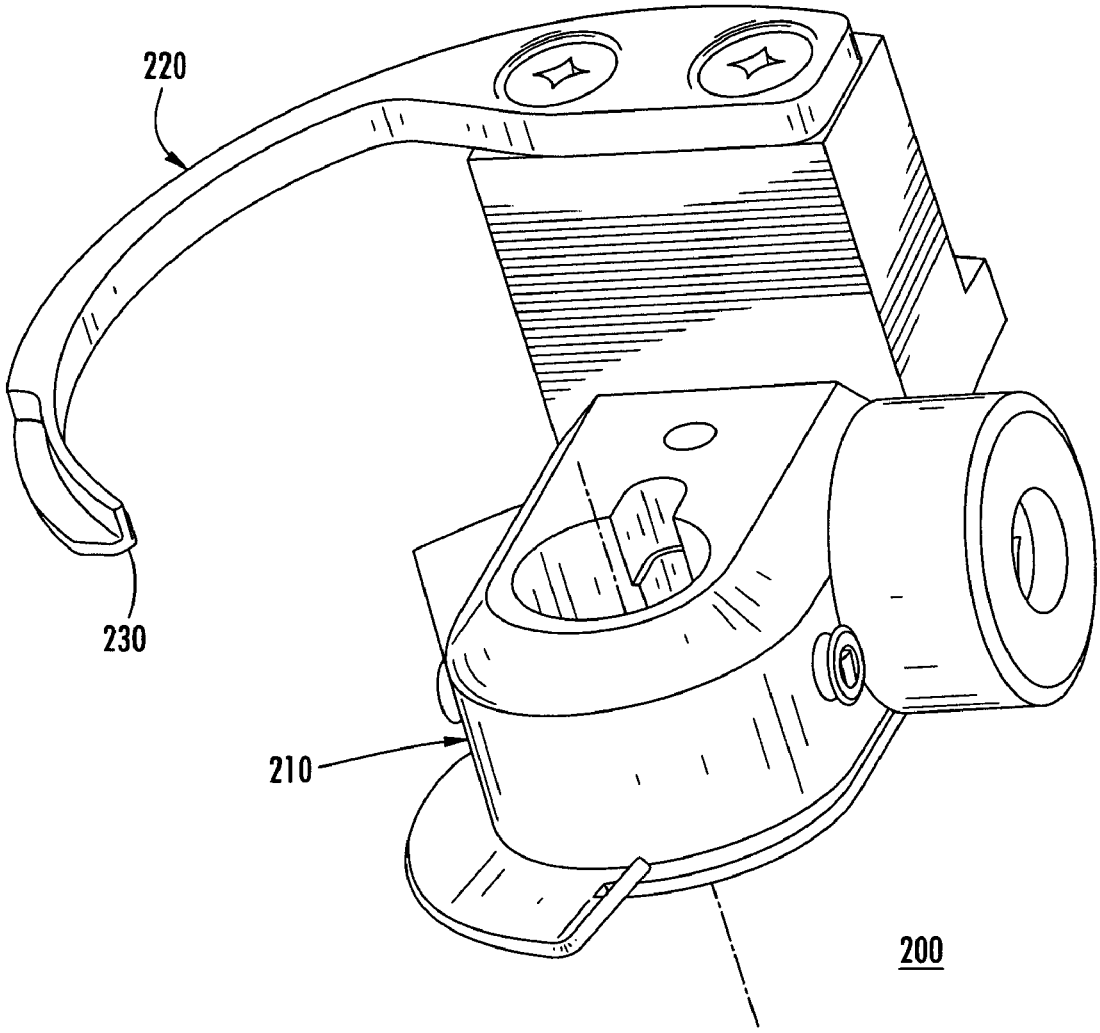
FIG. 2 illustrates a Sensormatic Electronics Corporation (SEC) hook and rotator block assembly of an embodiment.

FIG. 2 illustrates an SEC hook and rotator block assembly combination 200. In an embodiment, The SEC hook 220 is a curved steel bar that is 0.094" by 0.094" in cross section and has a Rockwell "C" hardness approximately between 54 and 58. The length of the SEC hook 220 is about ⅓ of the circumference of a circle with a 1" radius (i.e., approximately 2 inches). With respect to its attachment to the rotator block assembly 210, the SEC hook 220 includes a distal tip end 230. The tip end 230 cross section is in the shape of a backward "L." The "L" may extend toward the rotator block assembly 210 approximately 0.60 inch from the distal end of the SEC hook 220. In an embodiment, depending on the location of the "L" shaped keyway in the arcuate channel 130, the "L" of the tip end 230 may extend further or less than 0.06 inch as will be explained more fully below. The thickness of each leg on the backwards "L" is approximately 0.028 inch. The other end of the SEC hook 220 is mounted on a rotator block assembly 210 that rotates the SEC hook 220 about an axis of rotation at the center of the 1" radius circle congruent with the 1" radius circle for which SEC hook 220 spans an arc.

Figure 3:
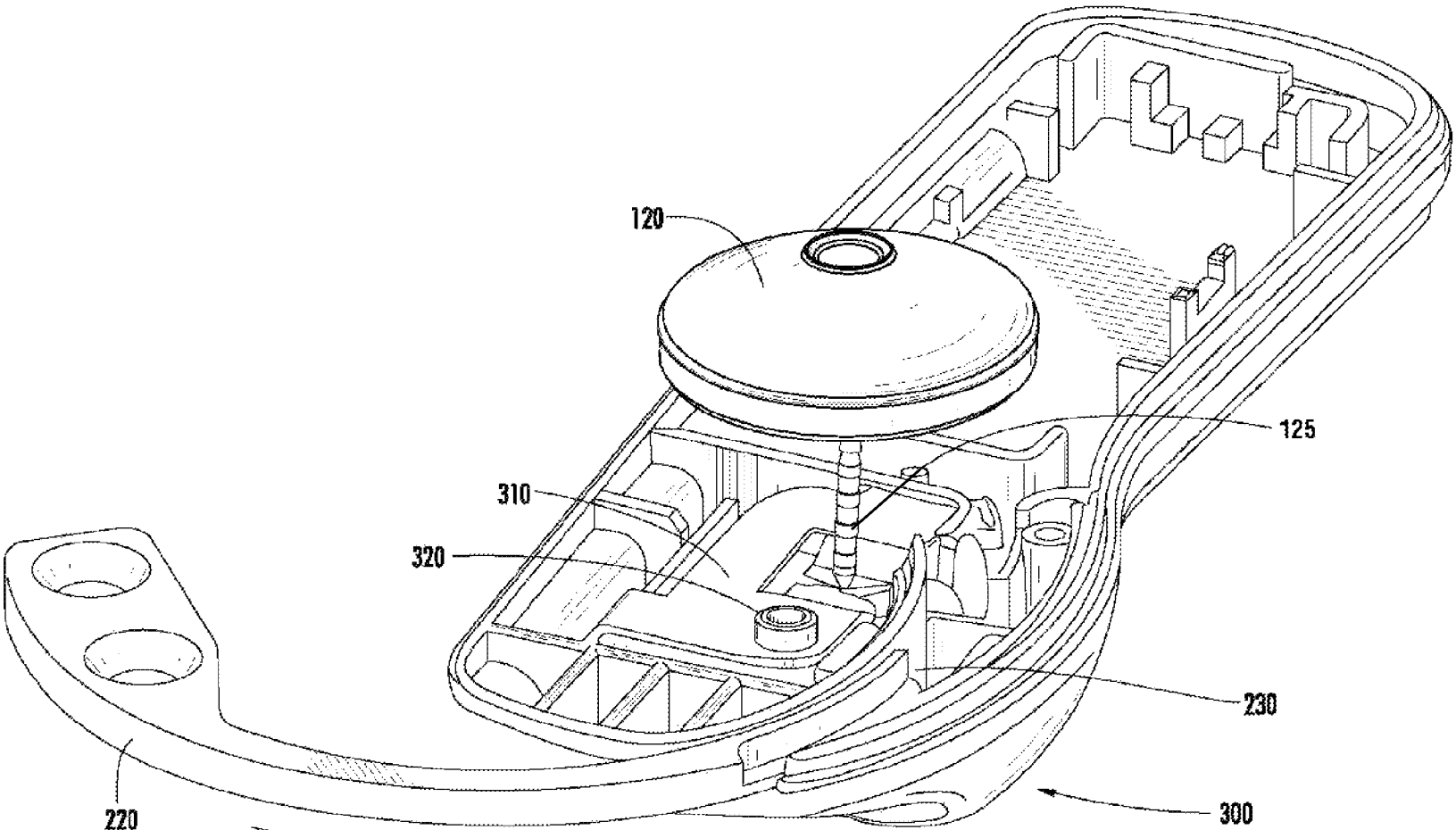
FIG. 3 illustrates a cutaway view of the EAS tag of an embodiment including the SEC hook and rotary clamp.

FIG. 3 illustrates a cutaway view of the EAS tag 100 including the SEC hook 220. In operation, the SEC hook 220 rotates along the axis of rotation of the rotator block assembly 210 (rotator block assembly not illustrated) such that the tip end 230 of the SEC hook 220 navigates the arcuate channel 130. The SEC hook 220 may be rotated into an L-shaped keyway in the arcuate channel 130 of the EAS tag 100 approximately 1 inch where the tip end 230 of the SEC hook 220 may engage and rotate a rotary clamp 310 about rotary clamp pivot point 320 approximately less than 5 degrees to unlock and release the pin 125 of the tack 120. The tack 120 can thereafter be removed from the EAS tag 100 housing, freeing the garment or other item to which it was attached. The rotary clamp 310 may be biased to the "lock" position, so when the released tack 120 is removed from the EAS tag 100, the rotary clamp 310 is ready to accept and detachably lock onto or grip another inserted tack 120.

Figure 4:
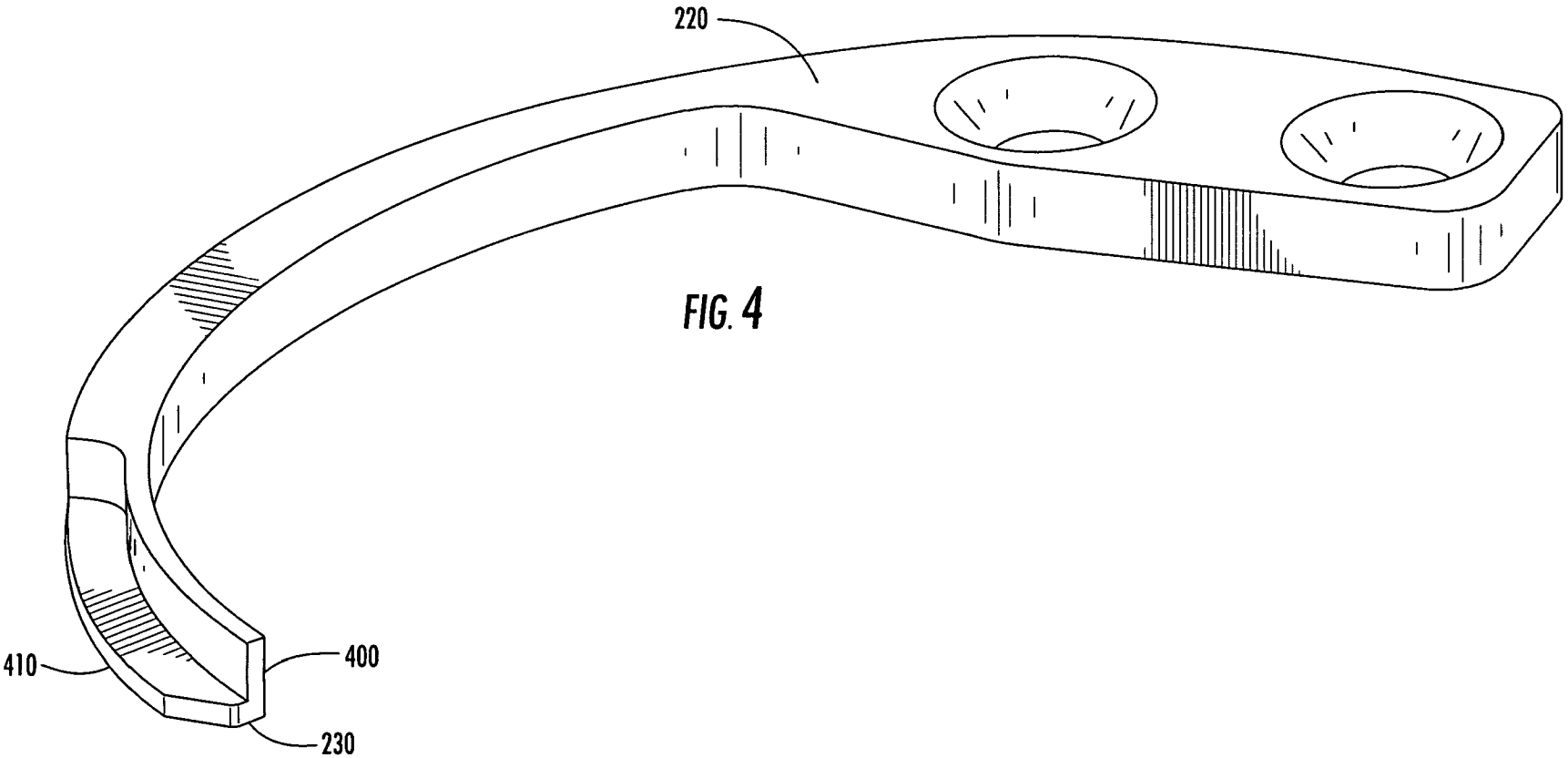
FIG. 4 illustrates the detail of an SEC hook.

FIG. 4 illustrates the detail of SEC hook 220. Tip end 230 of SEC hook 220 further includes vertical leg 400 and horizontal leg 410. As noted, the SEC hook 220 may be rotated into the arcuate channel 130 of the EAS tag 100 approximately 1 inch where the tip end 230 of the SEC hook 220 may engage and rotate a rotary clamp 310. In an embodiment, as will be described more fully below, the tip end 230 of the SEC hook 220 may further navigate an "L" shaped keyway within the arcuate channel 130. The overall cross section of the tip end 230 is approximately 0.094 inches by 0.094 inches. Both the vertical leg 400 and the horizontal 410 leg may have a thickness of approximately 0.028 inches. In an embodiment, the vertical leg 400, horizontal leg 410, or both may have a chamfer, fillet, or the like at one or more of their edges to facilitate the insertion of the SEC hook 220 including tip end 230 in the arcuate channel 130 and/or to facilitate the tip end 230 engagement with the rotary clamp 310.

Figures 5A, 5B:
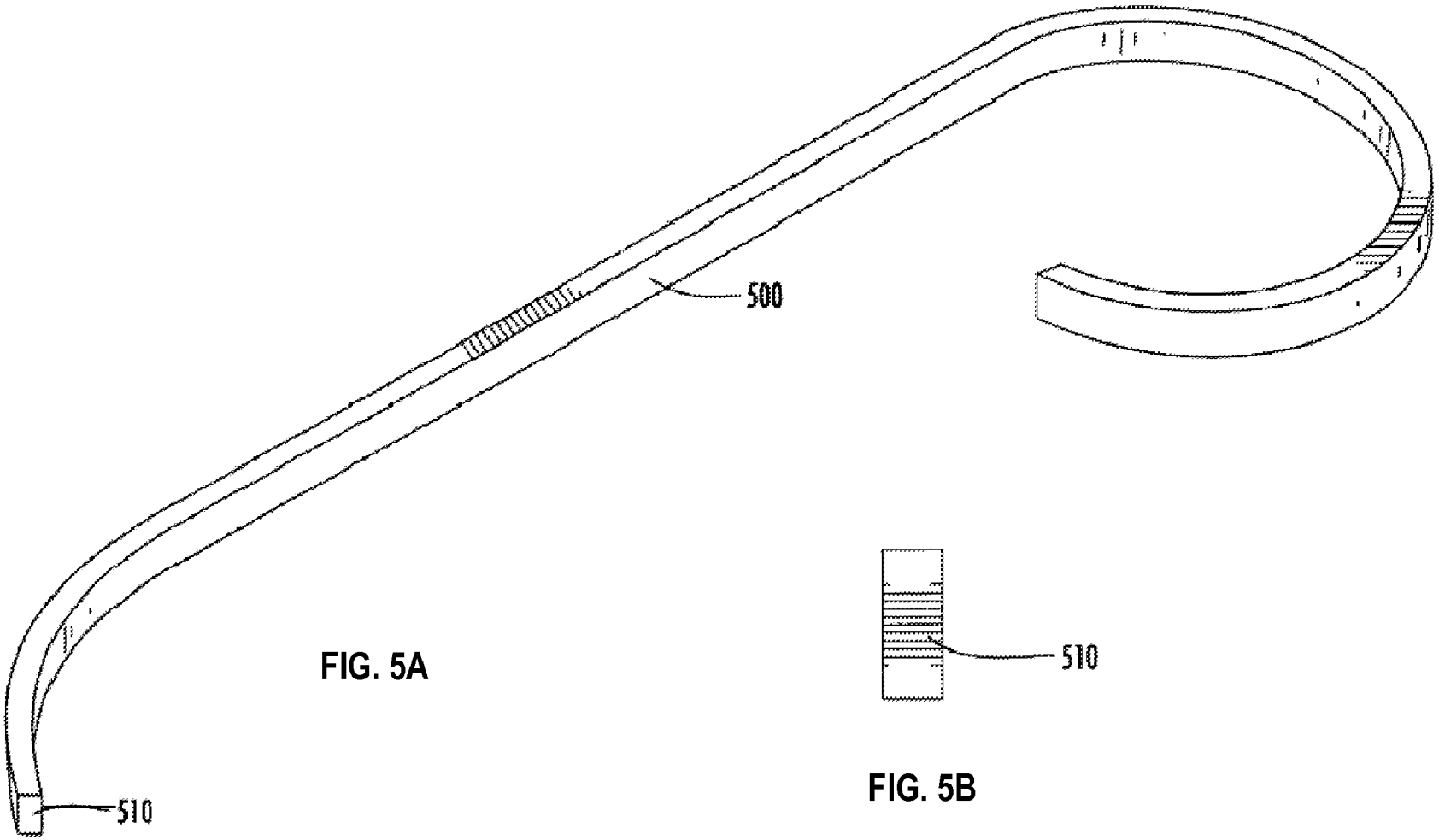
FIG. 5A illustrates a formed fish tape.
FIG. 5B is an end view of the formed fish tape of FIG. 5A

FIGS. 5A and 5B illustrate a formed fish tape 500 including tip end 510 that may be able to actuate the rotary clamp 310 and release pin 125 of tack 120 in lieu of SEC hook 220. Someone interested in bypassing an EAS system may use such a formed fish tape 500 to remove the EAS tag 100. For example, a thin rigid wire formed into a semicircle (cross section approximately 0.032 inches by 0.096 inches common to automobile windshield wiper blade inserts or electrical fish tape) may be forcibly inserted into the L-shaped key way inside the arcuate channel 130 until it engages the rotary clamp 310 and releases the pin 125 of tack 120. For an experienced operator, such an EAS system defeat may be performed in under ten seconds, thereby compromising the security features of the EAS system.

Figure 6:
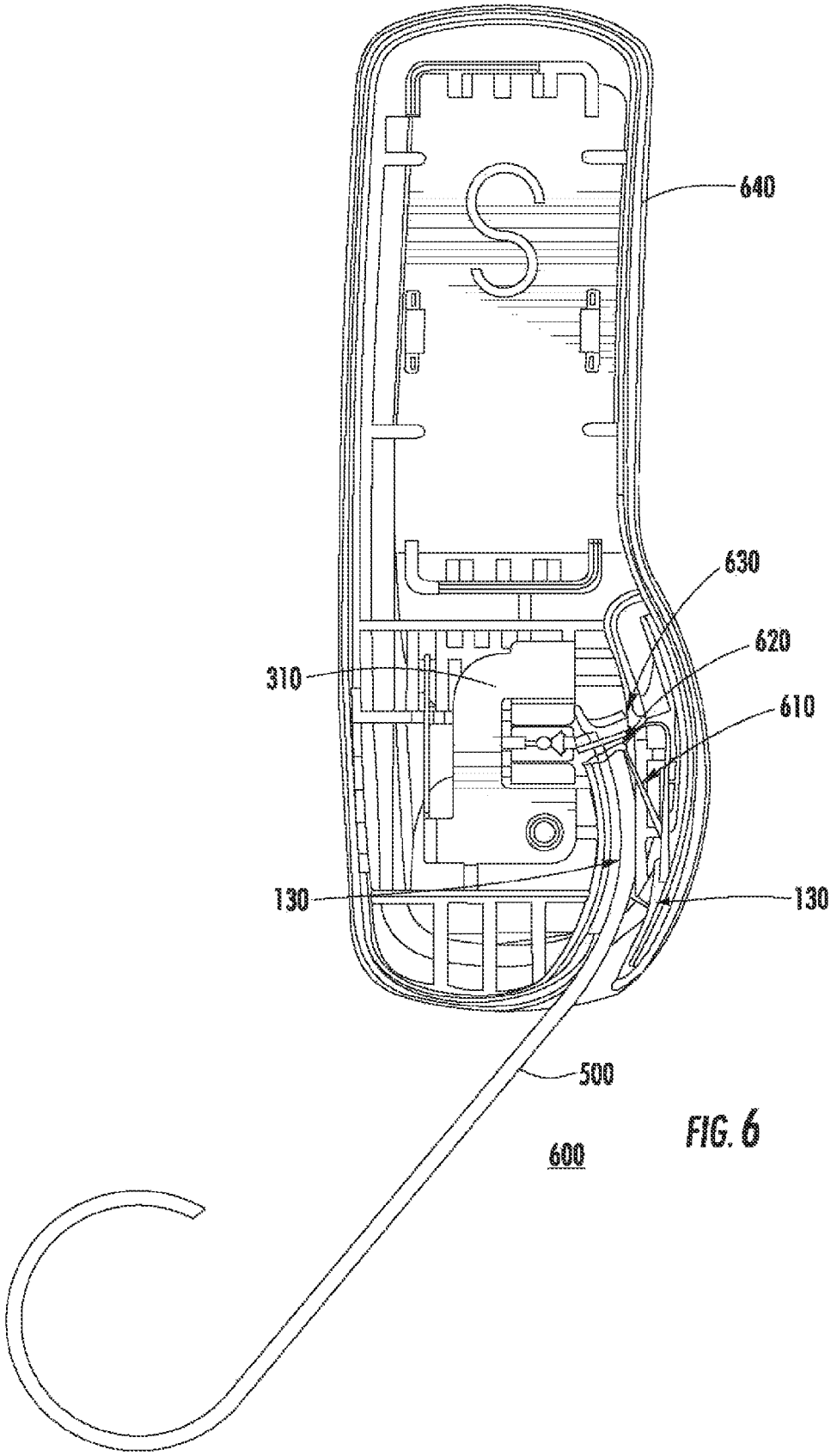
FIG. 6 illustrates an EAS tag of an embodiment.

FIG. 6 illustrates EAS tag 600 including several features to mitigate the use of a formed fish tape 500 to defeat the EAS system. In addition to the like-numbered features of EAS tag 100, EAS tag 600 may further include spring gate 610, catch 620, and abutment 630. The abutment 630 may be a substantially planar rigid member with a vertical and horizontal opening forming a substantially L:-shaped opening to receive the corresponding L-shape of the tip end 230 of the SEC hook 220. The rigid member of abutment 630 may be positioned substantially perpendicularly in the arcuate channel 130. The vertical opening of abutment 630 may be sized and positioned to allow the vertical leg 400 of the tip end 230 to closely pass through when the SEC hook 220 is inserted into the arcuate channel 130 to actuate, for example the rotary clamp 310 to release the pin 125 of tack 120.

The abutment 630 mechanism may further include a spring gate 610 assembly for preventing insertion of the formed fish tape 500. The spring gate 610 assembly may further include a catch 620 to catch the formed fish tape 500 and prevent further insertion of the formed fish tape 500 into the arcuate channel 130. The catch 620 may disposed on one end of the spring gate 610. The spring gate 610 may be attached to the EAS tag 600 body (i.e., lower housing 640) and biased so that the catch 620 may be against a wall of the arcuate channel 130 and in front of the vertical opening in the rigid member of abutment 630. In operation, the horizontal leg 410 of the SEC hook 220 may push against the bias of the spring gate 610 upon insertion of the SEC hook 220 in the arcuate channel 130 wherein the catch 620 is pushed away from the vertical opening in the rigid member of abutment 630 allowing the SEC hook 220 to closely pass therethrough. In an embodiment, the catch 620 may be a bent portion of the end of the spring gate 610.

Figure 7:
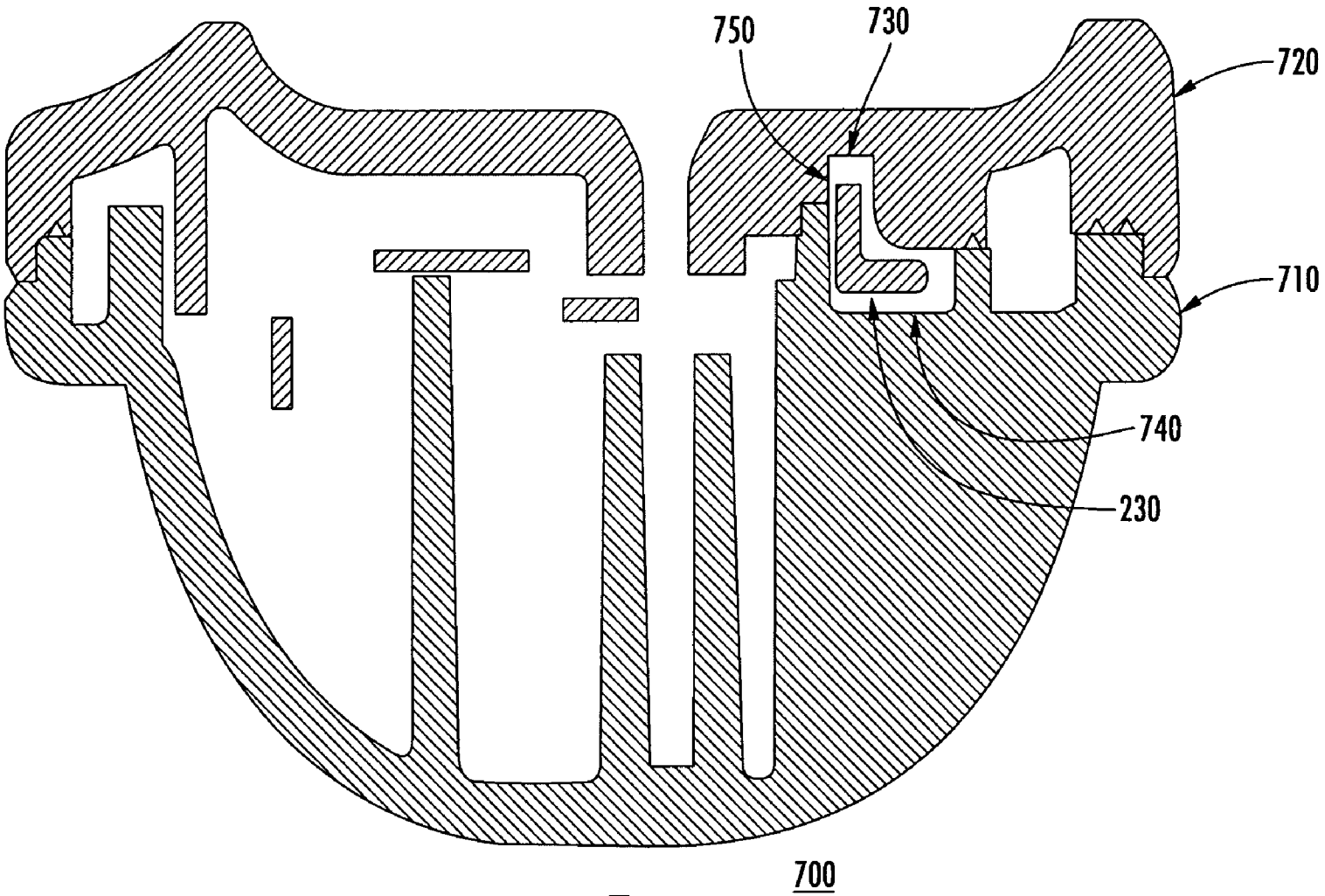
FIG. 7 illustrates a cross section of an EAS tag of an embodiment.
Figure 8:
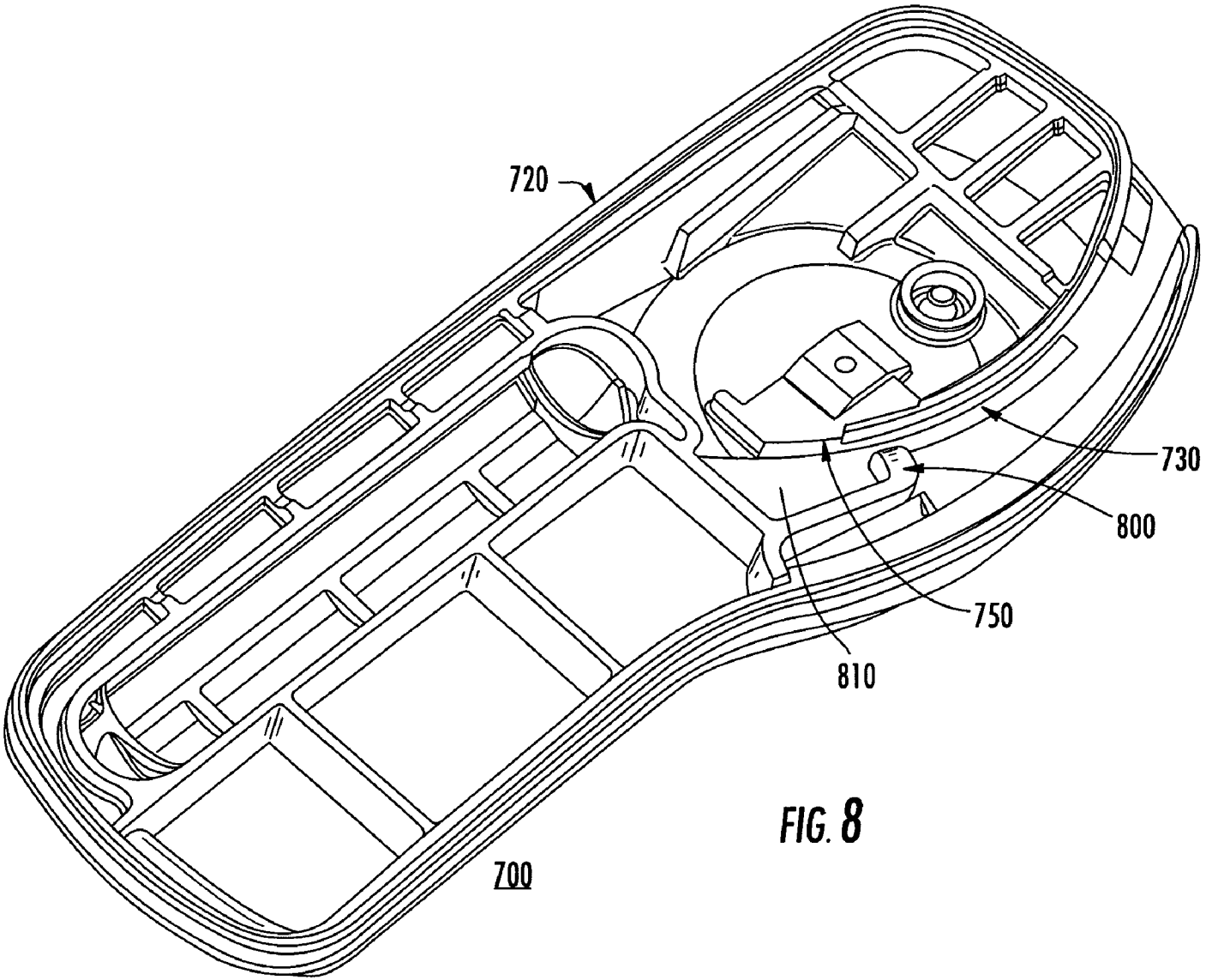
FIG. 8 illustrates a cutaway view of the upper housing of an EAS tag of an embodiment.

FIGS. 7 through 12 illustrate EAS tag 700 of an embodiment to further hinder the use of, for example, formed fish tape 500 to defeat the EAS system. For example, FIG. 7 illustrates a cross section of EAS tag 700 including SEC hook 220 in the arcuate channel 130. In an embodiment, at least a portion of the arcuate channel may have an L-shaped cross section similar to the tip end 230 of the SEC hook 220. In an embodiment, as illustrated by FIG. 8, the arcuate channel 130 may include an L-shaped keyway 800. The EAS tag of an embodiment may include, for example an upper housing 720 and a lower housing 710 that may be adjoined. Various features of the arcuate channel 130 and "L" shaped keyway 800 will be described in turn that both individually and in combination increase the difficulty of removing tack 120 without SEC hook 220.

For example, the channel horizontal leg 740 or channel vertical leg 750 or both may be altered at various points to combat, for example, formed fish tape 500. More specifically, as noted the formed fish tape 500 may have a cross section approximately 0.032 inches by 0.096 inches whereas each leg of the tip end 230 of SEC hook 220 (e.g., vertical leg 400 and horizontal leg 410) each is approximately 0.028 inches by 0.094 inches. Accordingly, either the channel horizontal leg 740, the channel vertical leg 730, or both may be fabricated to accept, for example, the 0.028 inch thick vertical leg 400 or horizontal leg 410 but may substantially reject the 0.032 inch thick formed fish tape 500 by narrowing the channel legs accordingly. For example, the horizontal leg and the vertical leg each may have a width of approximately between 0.028 and 0.032 inches and a height relative to their intersection of approximately between 0.094 and 0.096 inches to accommodate the tip end 230 of the SEC hook 220. The dimensions of an embodiment may also serve to better steer an intruding formed fish tape 500 (if forced into the arcuate channel 130 or of a different dimension than formed fish tape 500) into additional obstacles by providing less leeway for the formed fish tape 500 to circumnavigate the obstacles. In an embodiment, the channel horizontal leg 740 and the channel vertical leg 730 dimensions described above are formed by "L" shaped keyway 800 (through which, for example, FIG. 7 illustrates a cross section)

Further, the channel vertical leg, including channel vertical leg wall 750 may be altered. For example, if the channel horizontal leg 740 is constricted as noted above to accommodate the tip end 230 of SEC hook 220 and substantially reject the formed fish tape 500, the channel vertical leg 730 may be enlarged. In an embodiment, the channel vertical leg 730 vertical depth may be increased beyond that which would be required to accommodate the 0.094 inch vertical leg of the SEC hook 220. In an embodiment, the deeper vertical leg 730 may better guide the formed fish tape 500. In an embodiment, the deeper channel vertical leg 730 may preferentially guide the formed fish tape 500 so that the formed fish tape 500, when inserted in the arcuate channel 130, prefers the channel vertical leg 730 over the channel horizontal leg 740. In this fashion, in an embodiment a "road block" or other obstacle may be included in or adjacent to the channel vertical leg 730 that may impede or obstruct the advancement of the formed fish tape 500 to engage the rotary clamp 310 to release the pin 125 of tack 120. In an embodiment, the channel horizontal leg 740 and the channel vertical leg 730 dimensions described above are formed by "L" shaped keyway 800 (through which, for example, FIG. 7 illustrates a cross section).

As illustrated by FIG. 8, in an embodiment for which a portion of the arcuate channel 130 has an "L" shaped cross section, the "L" shaped cross section may be formed by "L" shaped keyway 800. Versus the entire arcuate channel 130 having an "L"shaped cross-section, the "L" shaped keyway of an embodiment may make it more difficult for a formed fish tape 500 to traverse the arcuate channel 130 and engage the rotary clamp 310 to release the pin 125 of tack 120.

For example, unless substantially formed in the same arc as the arcuate channel 130 (i.e., a 1.0 inch radius), without the entire "L" shaped length of the arcuate channel 130 to guide it, the formed fish tape 500 may encounter the face of the "L" shaped keyway 800 as an obstacle that would substantially prevent the further insertion of the formed fish tape 500 to engage the rotary clamp 310. Further, following the "L" keyway 800, the arcuate channel 130 may further open or widen, for example with a deeper channel vertical leg wall 750 or widened channel end 810. By each feature or combination of the features, a formed fish tape 500 that is inserted in the arcuate channel 130 and further advanced through the "L" keyway 800 may nevertheless, without additional guiding surfaces or walls following the "L" keyway 800, not have enough strength on its own to engage the rotary clamp 310 to release the pin 125 of tack 120.

Figure 9:
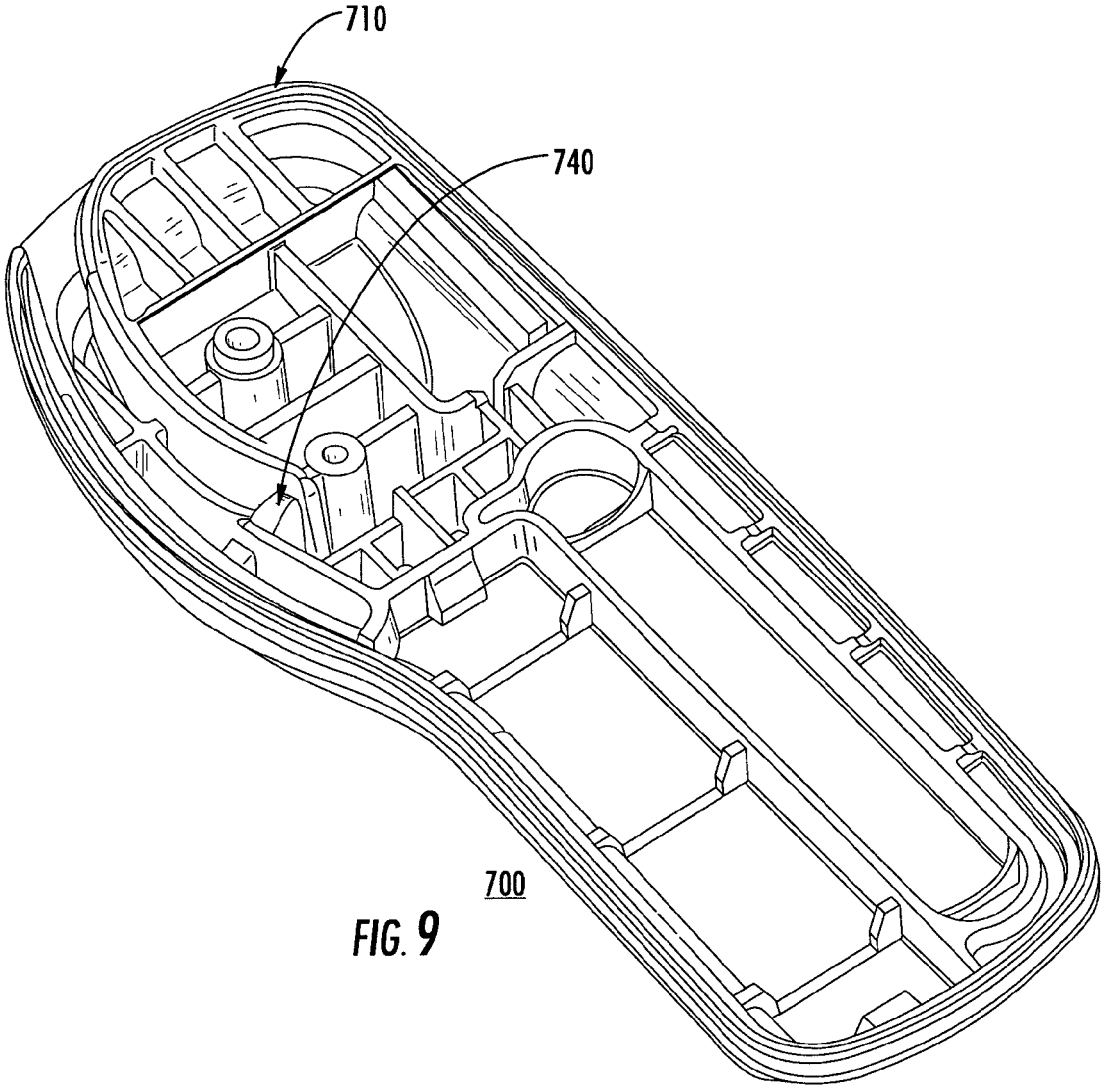
FIG. 9 illustrates a cutaway view of the lower housing of an EAS tag of an embodiment.
Figure 10:
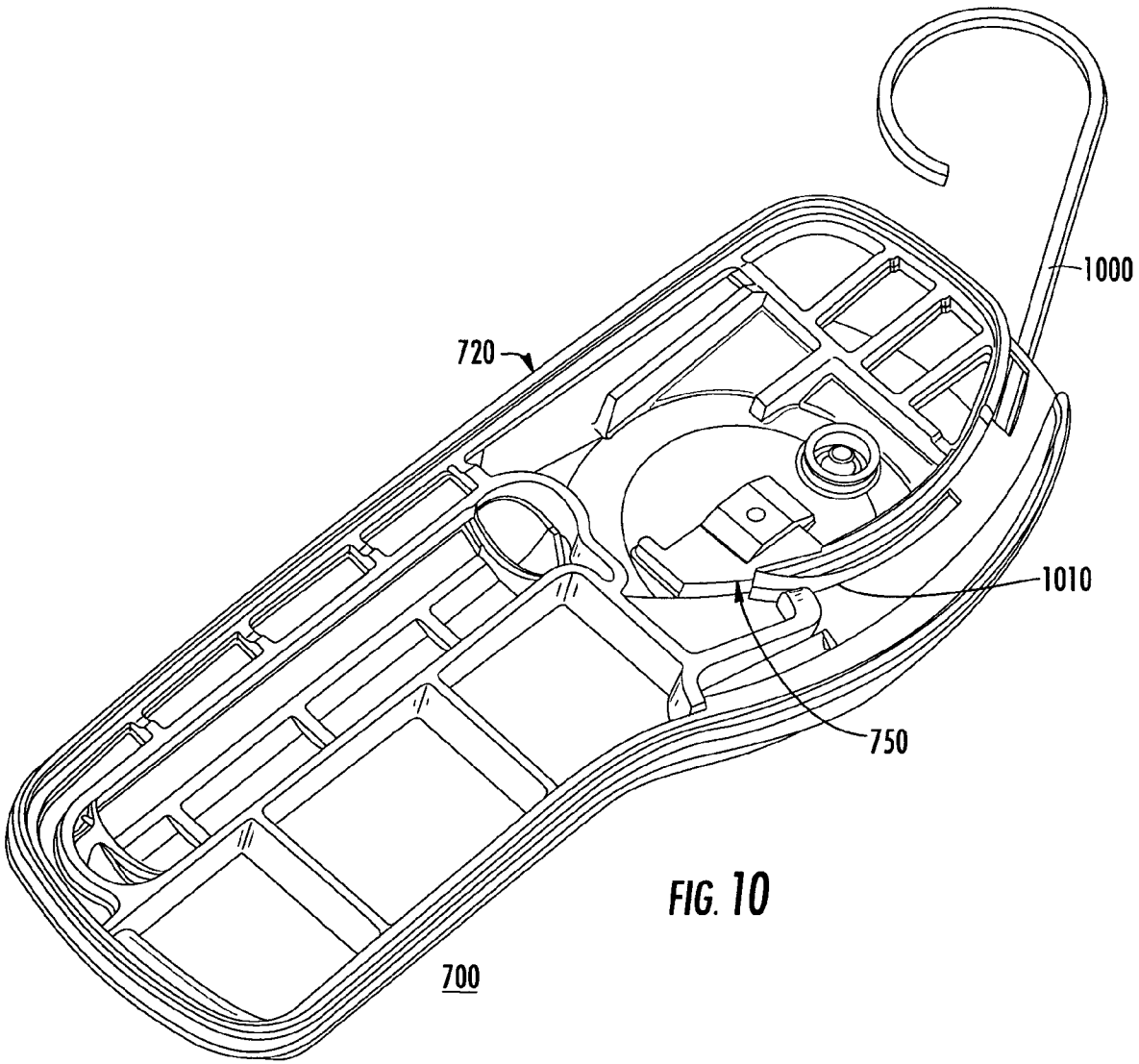
FIG. 10 illustrates a cutaway view of the upper housing of an EAS tag of an embodiment including a formed fish tape.

FIG. 9 illustrates the lower housing 710 of the EAS tag 700 of an embodiment including the channel horizontal leg 740. In an embodiment, the channel horizontal leg 740 forms part of the L-shaped keyway 800. The channel horizontal leg 740 may be a guiding surface, for example, for formed fish tape 500. More specifically, if the formed fish tape 500 is inserted into the channel vertical leg 730, it will slide along the surface of the channel horizontal leg 740 as a guide. The channel horizontal leg 740 can thereby steer the inserted formed fish tape into roadblocks or obstacles as will be explained with reference to FIG. 10 and FIG. 11.

Figure 11:
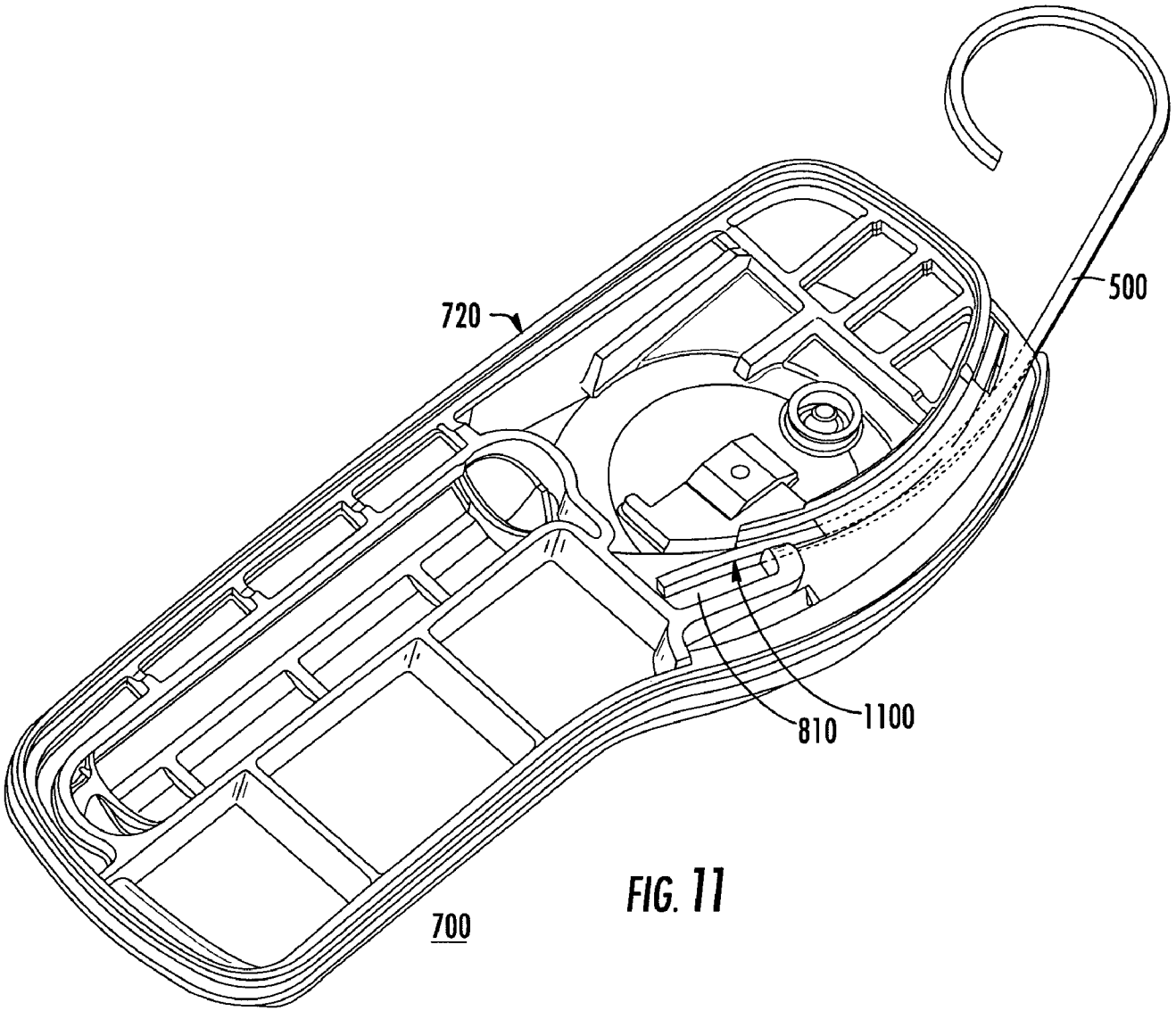
FIG. 11 illustrates a cutaway view of the upper housing of an EAS tag of an embodiment including a formed fish tape.

As noted, without guiding surfaces or walls, the formed fish tape may not have enough strength on its own to engage the rotary clamp 310 to release the pin 125 of tack 120. For example, and as illustrated by FIG. 11, to increase the strength of the formed fish tape 500, a kink bend 1010 may be formed in the fish tape as illustrated by formed fish tape 1000. The formed fish tape 1000 including kink bend 1010 may be advanced through the "L" shaped keyway 800, but upon exiting the "L" shaped keyway 800, the kink bend 1010 may steer the formed fish tape 1000 to a roadblock or obstacle created by the channel vertical leg wall 750. Accordingly, while the kink bend 1010 may be required to increase the strength of the formed fish tape 1000, it may nevertheless, given the channel vertical leg wall 750 roadblock, substantially prevent the formed fish tape 1000 from reaching the rotary clamp 310.

Conversely, and as explained with reference to the widening of the arcuate channel 130 at channel end 810 after the "L" shaped keyway, if the formed fish tape has a smooth bend (e.g., formed fish tape 500), following the traversal of the "L" shaped keyway 800, the widening of the arcuate channel across from the rotary clamp 310, coupled with the absence of a strength increasing kink bend 1010, encourages the formed fish tape 500 to flex away from the rotary clamp 310 as illustrated by flex 1100. As noted above, the formed fish tape 500 without additional guiding surfaces or walls between the "L" shaped keyway 800 and the rotary clamp 310 may not have enough strength on its own to engage the rotary clamp 310 to release the pin 125 of tack 120.

Figure 12:
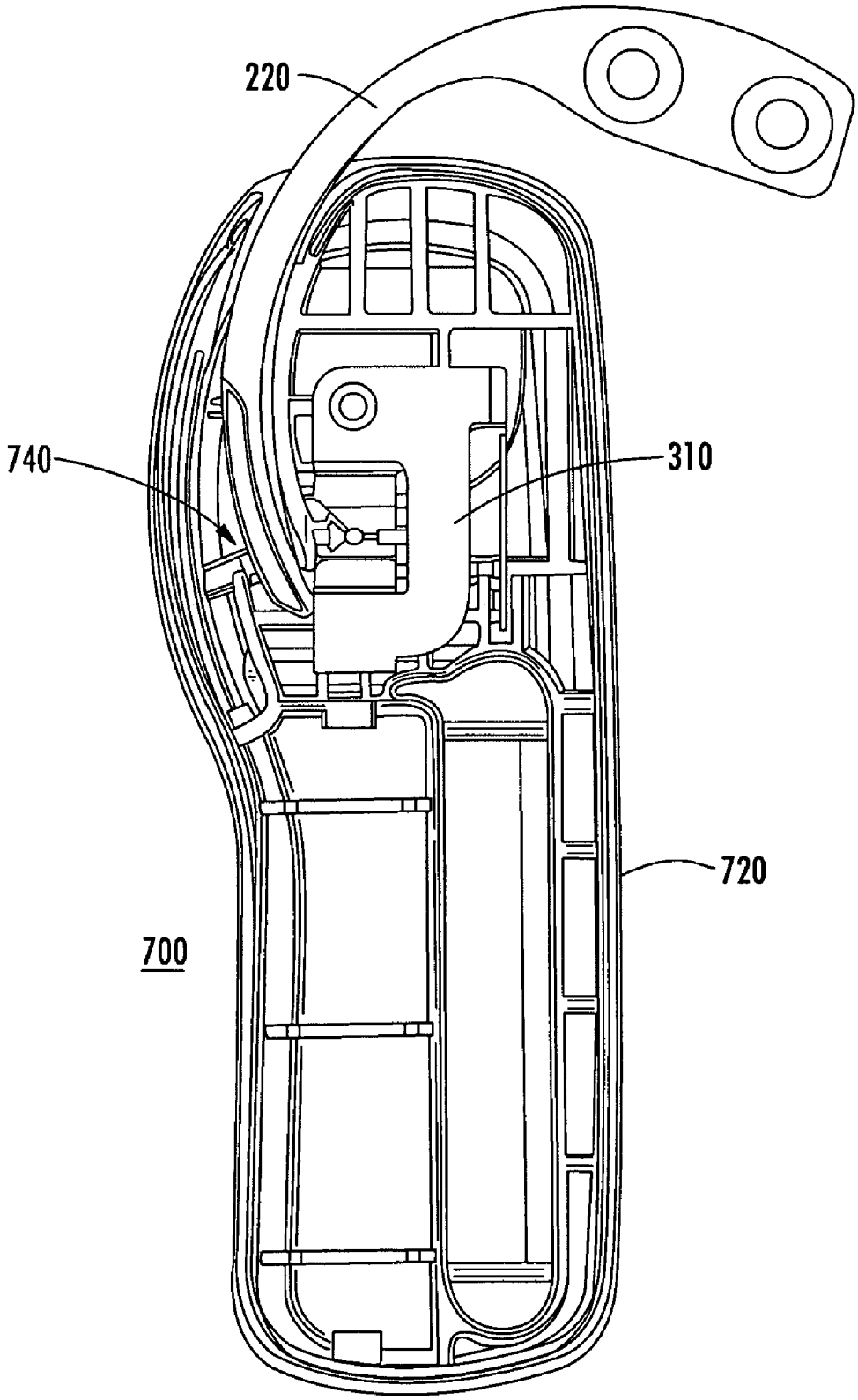
FIG. 12 illustrates a cutaway view of the upper housing of an EAS tag of an embodiment including an SEC hook and a rotary clamp.

FIG. 12 illustrates the EAS tag 700 of an embodiment including, for example, the "L" shaped keyway 800. Unlike formed fish tape 500 or formed fish tape 1000 including kink bend 1010, the SEC hook 220 may navigate the arcuate channel 130, and in particular the "L" shaped keyway 800 and the various roadblocks and obstacles formed thereby, to contact and engage the rotary clamp 310 to release the pin 125 of tack 120.

It is to be understood that while illustrated (e.g., by FIG. 7) and described substantially in the same cross section, in an embodiment the legs of the "L" shaped keyway 800 (e.g., horizontal leg 740 and vertical leg 730) may be alternatively positioned. For example, one leg of the "L" shaped keyway 800 may be positioned at a different location along the arcuate channel 130 than the other leg of the "L" shaped keyway 800. For example, the formed fish tape 500 may experience, as it is inserted into and traverses the arcuate channel 130, one leg of the "L" shaped keyway at a different depth than the other leg. The separation or combination of the horizontal leg 740 and vertical leg 730 of the "L" shaped keyway 800 may further allow the "L" shaped keyway 800 to be more precisely configured to hinder or substantially interrupt the intrusion of "L" shaped keyway 800.

Figure 13:
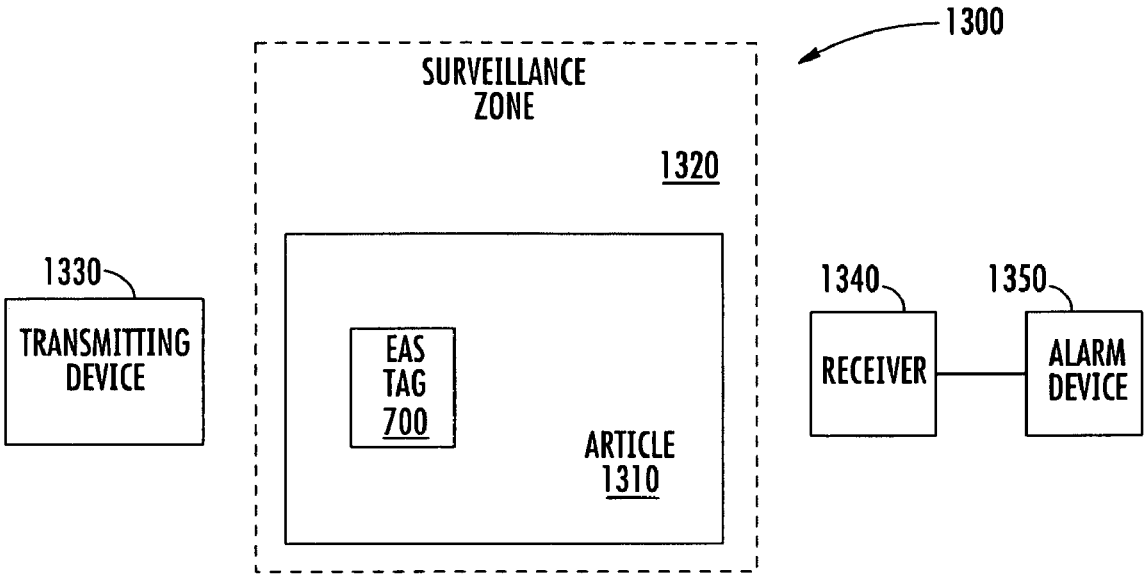
FIG. 13 illustrates an EAS system including an EAS tag of an embodiment.

FIG. 13 illustrates an EAS system including the EAS tag 700 of an embodiment. FIG. 13 shows an EAS system 1300 used to detect or sense the EAS tag 700 of an embodiment, for example attached to article 1310, when passing through a surveillance zone 1320. An interrogation signal is transmitted into the zone 1320 via a transmitting device 1330. A signal resulting from interaction of a sensor in the EAS tag with the transmitted signal is received at a receiver 1340 that communicates with a detection and alarm device 1350. The latter detects the received signal and generates an alarm indicating the presence of the EAS tag 700 and the article 1310 in the surveillance zone 1320.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

What is claimed is:

1. An electronic article surveillance (EAS) tag comprising:

a body;

a rotary clamp coupled to the body to clamp a pin of a removable tack to detachably engage the EAS tag to an object; and an arcuate channel disposed in the body, one end of said arcuate channel opening at a side surface of the body, an opposite end of said arcuate channel disposed adjacent to the rotary clamp, the arcuate channel to include a keyway formed in a portion of the arcuate channel, wherein the keyway comprises an "L" shaped keyway to allow the insertion of a hook into the arcuate channel to operate the rotary clamp, the "L" shaped keyway further to substantially prevent the insertion of a fish tape into the arcuate channel to operate the rotary clamp;

wherein the arcuate channel has a length as measured between the ends of the arcuate channel, the "L" shaped keyway further including a vertical leg and a horizontal leg'the horizontal leg and the vertical leg of the "L" shaped keyway to be located at different distances along the length of the arcuate channel.

2. The EAS tag of claim 1, the horizontal leg and the vertical leg each having a width relative to an intersection of the horizontal leg and the vertical leg of approximately between 0.028 and 0.032 inches and a height relative to the intersection of the horizontal leg and the vertical leg of approximately between 0.094 and 0.096 inches.

3. The EAS tag of claim 2, the arcuate channel to include a widened portion disposed farther away from the side surface of the body than the "L" shaped keyway.

4. The EAS tag of claim 2, further comprising an obstacle positioned within the body adjacent to a second radius of the arcuate channel, the obstacle located at a point along the length of the arcuate channel that is farther from the side surface than that of said "L" shaped keyway, the obstacle to engage the fish tape to prevent movement of the fish tape along the arcuate channel.

5. An electronic article surveillance (EAS) tag comprising:

a body;

a rotary clamp within the body; and an arcuate channel disposed in the body, one end of said arcuate channel opening at a side surface of the body, an opposite end of said arcuate channel disposed adjacent to the rotary clamp, the arcuate channel to include an "L" shaped keyway, the body further including an obstacle positioned adjacent to a second radius of the arcuate channel at a point along a length of the arcuate channel that is farther from the side surface than that of the keyway to substantially prevent a formed fish tape including a kink bend from engaging the rotary clamp;

wherein the "L" shaped keyway further including a vertical leg and a horizontal leg, the horizontal leg and the vertical leg of the "L" shaped keyway to be located at different distances along the length of the arcuate channel.

6. The EAS tag of claim 5, the horizontal leg and the vertical leg each having a width relative to an intersection of the horizontal leg and the vertical leg of approximately between 0.028 and 0.032 inches and a height relative to the intersection of the horizontal leg and the vertical leg of approximately between 0.094 and 0.096 inches.

7. The EAS tag of claim 5, the arcuate channel to include a widened portion disposed farther away from the side surface of the body than the keyway to substantially prevent a formed fish tape from engaging the rotary clamp.

8. An electronic article surveillance (EAS) system comprising:

an EAS tag attachable to an article, the EAS tag including a body, a rotary clamp within the body, and an arcuate channel disposed in the body, one end of said arcuate channel opening at a side surface of the body, an opposite end of said arcuate channel disposed adjacent to the rotary clamp, the arcuate channel to include an "L" shaped keyway, the "L" shaped keyway including a vertical leg and a horizontal leg, the horizontal leg and the vertical leg of the "L" shaped keyway to be located at different distances along a length of the arcuate channel;

an obstacle disposed within the body and positioned adjacent to a second radius of the arcuate channel at a point along the length of the arcuate channel that is farther from the side surface than that of the keyway to substantially prevent a formed fish tape including a kink bend from engaging the rotary clamp;

a detectable EAS sensor disposed in the EAS tag body;

a transmitter to transmit a first signal into a surveillance zone; and a receiver to receive a second signal resulting from the interaction of the first signal with the detectable EAS sensor to detect the presence of the detectable EAS sensor in the surveillance zone.

9. The EAS system of claim 8, the horizontal leg and the vertical leg each having a width relative to an intersection of the horizontal leg and the vertical leg of approximately between 0.028 and 0.032 inches and a height relative to the intersection of the horizontal leg and the vertical leg of approximately between 0.094 and 0.096 inches.

10. The EAS system of claim 8, the arcuate channel to include a widened portion disposed farther away from the side surface of the body than the keyway to substantially prevent a formed fish tape from engaging the rotary clamp.

* * * * *